US006105672A

United States Patent [19]

Deruyter et al.

[11] Patent Number: 6,105,672

[45] Date of Patent: Aug. 22, 2000

[54] ENHANCED PETROLEUM FLUID RECOVERY PROCESS IN AN UNDERGROUND RESERVOIR

[75] Inventors: Christian Deruyter, Rueil-Malmaison; Jean-Claude Moulu, Aubergenville, both of France

[73] Assignee: Institut Francais du Petrole, Cedex, France

[21] Appl. No.: 09/098,497

[22] Filed: Jun. 17, 1998

[30] Foreign Application Priority Data

Jun. 17, 1997 [FR] France ..... 97 07611

[51] Int. Cl.[7] ..... E21B 43/22

[52] U.S. Cl. ..... 166/270.1; 166/401; 166/402; 166/403

[58] Field of Search ..... 166/270.1, 400, 166/401, 402, 403, 275, 263; 507/202

[56] References Cited

U.S. PATENT DOCUMENTS

| | | | |
|---|---|---|---|
| 3,032,101 | 5/1962 | Woertz et al. . | |
| 3,342,256 | 9/1967 | Bernard et al. | 166/403 |
| 3,529,668 | 9/1970 | Bernard | 166/403 |
| 3,580,335 | 5/1971 | Allen et al. | 166/401 |
| 3,599,717 | 8/1971 | McMillen | 166/401 |
| 3,800,874 | 4/1974 | Kern | 166/402 |
| 3,893,511 | 7/1975 | Root | 166/305.1 |
| 4,224,992 | 9/1980 | Comberiati et al. | 166/402 |
| 4,601,337 | 7/1986 | Lau et al. | 166/270.1 |
| 4,683,948 | 8/1987 | Fleming | 166/402 |
| 4,856,589 | 8/1989 | Kuhlman et al. | 166/403 |
| 5,758,727 | 6/1998 | Moulu et al. | 166/401 |

FOREIGN PATENT DOCUMENTS

| | | |
|---|---|---|
| 2735524 | 12/1996 | France . |
| 2302107 | 1/1997 | United Kingdom . |

OTHER PUBLICATIONS

Perez et al "Carbonated Water Imbibition Flooding: An Enhanced Oil Recovery Process for Fractured Reservoirs", SPE/DOE 8th Symposium on Enhanced Oil Recovery, Apr. 22–24, 1998, Tulsa, Oklahoma, USA, pp. 79–90, XP002057954.

*Primary Examiner*—George Suchfield
*Attorney, Agent, or Firm*—Antonelli, Terry, Stout & Kraus, LLP

[57] ABSTRACT

Enhanced (WAG type) oil recovery process in an underground reservoir uses forced injection, through one or more wells, alternately of fluid slugs and gas slugs, and recovery, through one or more production wells, of petroleum fluids displaced by the wetting fluid and the gas injected. The process includes dissolving a pressurized gas in the liquid of certain slugs and, after injection, relieving the pressure prevailing in the reservoir so as to generate gas bubbles by nucleation in the smallest pores, which has the effect of driving the oil away from the less permeable zones into the more permeable zones (with large pores or with fractures) where the oil is swept by the gas slugs injected later on. Implementation of the process considerably increases the oil recovery ratio that is usually reached with WAG type processes.

7 Claims, No Drawings

ENHANCED PETROLEUM FLUID RECOVERY PROCESS IN AN UNDERGROUND RESERVOIR

FIELD OF THE INVENTION

The present invention relates to an enhanced petroleum fluid recovery method in an underground reservoir allowing to increase the sweep efficiency and more particularly to improve a recovery technique.

BACKGROUND OF THE INVENTION

Primary or secondary type recovery methods that are well-known to specialists can be used in order to better displace petroleum fluids towards production wells. The recovery is referred to as primary when the in-situ energy is used. Expansion of the fluids that are initially under high pressure in the reservoir allows part of the oil in place to be recovered. During this stage, the pressure in the reservoir can fall below the bubble point and a gas phase appears, which contributes to increasing the recovery ratio.

Secondary type recovery methods are rather used in order to avoid too great a pressure decrease in the reservoir. The principle consists in displacing the petroleum fluids by means of an energy supply external to the reservoir. Fluids are injected into the reservoir through one or more injection wells and the petroleum fluids displaced (referred to as "oil" hereafter) are recovered by means of production wells.

Water can be used as a displacement fluid but it has a limited efficiency. A large part of the oil remains in place notably because the viscosity thereof is often much higher than that of water. Besides, the oil often remains trapped by the contractions of the pores due to the great interfacial tension between the oil and the water. Since the reservoir is often heterogeneous, the water readily sweeps the most permeable zones while bypassing the others, hence a great recovery loss.

It is also well-known to inject pressurized gas that penetrates the pores of the rock and displaces a large amount of the oil in place. Even if water has first been injected into the reservoir, as it is often the case, gas has a well-known property of displacing an additional amount of oil that can be significant.

A notable drawback of this recovery technique using gas is that the latter is much less viscous than the oil to be displaced and than the water possibly in place. Because of the high mobility thereof, the gas flows through the reservoir by following only some of the most permeable channels that reach the production well(s) without displacing a large amount of oil.

If the reservoir is not homogeneous and comprises layers or cores of different permeability, this effect becomes still more pronounced and the gas, bypassing the least permeable zones, reaches the production wells even faster. When the gas thus breaks through prematurely without having the expected displacement effect, it loses all of its efficiency. To continue injection thus has no practical effect any more.

It is also well-known to combine the two techniques according to a method referred to as WAG method. Water and gas are successively injected and this sequence is repeated by alternating water slugs and gas slugs as long as oil is produced under good economic conditions. This combined injection method produces better results since the mobility of the gas of each slug, which is more efficient than water at the level of the pores, is relatively reduced by the presence of the water slug preceding it. However, as a result of the reduced volume of the slugs in relation to the distance they must cover between the injection wells and the production wells and of the heterogeneity of the reservoir, the efficiency of the macroscopic sweep does not last long. Surfactants can be added to the water in order to decrease the water-oil interfacial tension and to improve the efficiency of these combined injections. The foam that forms in the presence of the gas has the effect of reducing the mobility of the gas and the fingerings. Such a method using alternate slugs is for example described in patent U.S. Pat. No. 5,465,790.

Patent FR-2,735,524 filed by the applicant describes a method allowing to displace petroleum fluids out of an underground reservoir by means of successive injections, through one or more injection wells, of slugs consisting of a wetting fluid such as water and of gas slugs, and the recovery, through one or more production wells, of the petroleum fluids displaced by the wetting fluid and the gas injected. This method mainly consists in adding to at least one slug of the wetting liquid injected an amount of substances suited to make the spreading coefficient negative. Alcohol is notably used in a proportion of 1 to 5% by weight for example. It may be, for example, a low molecular weight alcohol belonging to the isobutyl or isoamyl alcohol class. Light polar compounds such as amines, fluorinated products or light acids may also be used.

SUMMARY OF THE INVENTION

The process according to the present invention allows petroleum fluids retained in the pores of a porous underground reservoir to be displaced. It comprises a stage of forced injection, through one or more injection wells successively, of fluid slugs intended to displace the hydrocarbons in the reservoir rocks and a stage of recovery, through one or more production wells, of the hydrocarbons displaced.

It is characterized in that the injection stage comprises successive injection of wetting liquid slugs which have been saturated with a pressurized gas that is soluble in said wetting liquid, and of gas slugs intended to sweep the more permeable zones, and the production stage comprises relieving the pressure prevailing in the reservoir so as to generate in situ gas bubbles by nucleation in the pores of the less permeable zones (part of the matrix comprising the smallest pores) and to drive the hydrocarbons therefrom towards more permeable zones where they are displaced by the gas slugs.

On expanding, part of the dissolved gas is released as bubbles, preferentially on irregular surface elements and therefore on the pore walls.

The nucleation effect is more marked where the pore wall density per unit of volume is the highest, i.e. in zones of lower permeability with smaller pores where oil is the most difficult to drive away. The very efficient sweep caused by this nucleation in the least accessible zones of the reservoir allows to greatly improve the oil recovery ratio.

The sweep operation thus occurs in two stages. First, by relieving the pressure of the gas dissolved in the water slugs and by nucleation, the oil is forced out of the least permeable pores into more permeable zones, and thereafter the gas of the following gas slugs, whose purpose is precisely to sweep the most permeable zones, is used to displace this oil recovered during the first stage towards the producing well.

The wetting fluid is for example water, at least one slug of the water injected being saturated with pressurized carbon dioxide for example or hydrogen sulfide.

According to an embodiment, at least one of the wetting liquid slugs injected during the injection stage can comprise water to which a substance suited to make the spreading coefficient of the hydrocarbon drops negative, alcohol for example, has been added. It is thus possible to alternate the wetting liquid slugs, some being saturated with pressurized gas, others to which said substance has been added, others without any additive.

According to another embodiment, at least one of the wetting liquid slugs injected during the injection stage comprises water to which foaming agents or surfactants have been added so that the pressure decrease in the reservoir generates the in-situ formation of foams, which greatly simplifies implementation of this type of sweep.

Comparative laboratory tests carried out on a physical model of an oil-impregnated heterogeneous rock showed that the recovery ratio obtained by applying the process according to the invention can reach nearly 20%, whereas a conventional WAG type process leads at best to a recovery ratio of 8 to 9% only.

EXPERIMENTAL RESULTS

Other features and advantages of the process according to the invention will be clear from reading the experimental results hereafter.

The physical model described in the claimant's patent application FR-A-2,748,472, which was made to model a heterogeneous medium, is used to test the validity of the process. It comprises an inhomogeneous block obtained by juxtaposing in a vessel for example at least two volumes of materials of different porosity and melting temperature and by placing the vessel in an oven whose temperature is programmed to rise progressively until a sufficient temperature is reached for softening of the porous material with the lower melting temperature during a first time interval, to stabilize during a second predetermined time interval and to slowly decrease to room temperature during a third time interval. The porous material that has softened constitutes a means of sticking the materials together, thus preventing for example formation of an air stream which would constitute a preferential passage for the fluids by preventing formation of an interzone forming a capillary barrier.

Such a block can be constituted by using a juxtaposition of a natural porous material such as sandstone notably, with a permeability of the order of 70 mD for example, and of a composite material such as powdered glass for example.

The physical model formed exhibits the shape of a bar of length L=21.2 cm and of section S=19.6 $cm^2$, whose pore volume is 110 $cm^3$. The bar is provided at both ends with two joining pieces that are conventionally connected to water and oil injection and drainage circuits.

The bar was prepared by means of the following operations in order to bring it successively to a state of irreducible water saturation Swi and of residual oil saturation Sor.

| Setting to Swi | | |
|---|---|---|
| Volume of oil injected | Volume of water recovered | Injection pressure |
| 100 $cm^3$/h | 75 $cm^3$ | 22 kPa |
| 200 $cm^3$/h | 82 $cm^3$ | 28 kPa |

-continued

| Setting to Swi | | |
|---|---|---|
| Volume of oil injected | Volume of water recovered | Injection pressure |
| 300 $cm^3$/h | 85 $cm^3$ | 35 kPa |
| 400 $cm^3$/h | 88 $cm^3$ | 40 kPa |

Volume of oil in place = 88 $cm^3$ => Swi = (110 − 88)/110 = 20%.

| Setting to Sor | | |
|---|---|---|
| Volume of water injected | Volume of oil recovered | Injection pressure |
| 200 $cm^3$/h | 64 $cm^3$ | 24 kPa |
| 400 $cm^3$/h | 65 $cm^3$ | 54 kPa |

Dead volume Vm = 2 $cm^3$ => Sor = (88 − 67)/110 = 21/110 = 19%.

A conventional method known as WAG was performed with alternate injection in the model of 10 $cm^3$ water and gas slugs at the injection pressure and with the flow rates mentioned, the oil recovery results being given in the table hereunder:

| | Water slug 100 $cm^3$/h | Gas slug 50 $cm^3$/h | Recovery/h in $cm^3$ | Injection pressure in kPa |
|---|---|---|---|---|
| 1 | | | 0 | 14 |
| 2 | | | 0 | 20 |
| 3 | | | 0 | 24 |
| 4 | | | 0 | 22 |
| 5 | | | 0 | 32 |
| 6 | | | gas breakthrough | 26 |
| 7 | | | 0.5 | 30 |
| 8 | | | 0.6 | 28 |
| 9 | | | 0.8 | 34 |
| 10 | | | 0.8 | 33 |
| 11 | | | 0.8 | 32 |
| 12 | | | 1.2 | 28 |
| 13 | | | 1.2 | 32 |
| 14 | | | 1.2 | 32 |
| 15 | | | 1.2 | 33 |
| 16 | | | 1.4 | 30 |
| 17 | | | 1.8 | 36 |

Results: oil in place recovery % 1.8/21*100 = 8.5%.

The method according to the invention was implemented thereafter as follows:

Preparation of the water saturated with a gas at a pressure Psat=150 kPa. Injection of this water at a low flow rate in the model: 1 Vp in about 6 hours—with $P_{inlet}$=150 kPa, $P_{outlet}$= 135 kPa—Sudden expansion to atmospheric pressure, nucleation in the porous medium for 16 hours. Injection of a water slug at 100 $cm^3$/h, recovery of 2 $cm^3$ of additional oil, i.e. 2/21 or, in percent, 9.5% of the Sor or 10.5% of the gain after tertiary recovery, which represents a considerable improvement in relation to a conventional method.

A new injection of a carbon dioxide-saturated water slug, followed by a water slug, allowed to bring the oil in place (Sor) recovery up to 12.5%, i.e. another 3% increase.

According to another embodiment, foaming agents or surfactants are added to injected water slugs. The pressure drop generated after injection has the effect of causing these additives to foam or to emulsify, which allows to greatly simplify the problems generally posed by injection of these additives.

According to another embodiment, the effects specific to the method according to the invention can be combined with those described in the aforementioned patent FR-2,735,524, i.e. the formation of meniscuses resulting from the addition to the water of substances such as alcohol which modify the spreading coefficient.

In the previous examples, carbon dioxide has been selected to saturate at least some of the water slugs because of the low cost of this gas. However, without departing from the scope of the method, it is possible to use other gases having the distinctive feature, more marked than for carbon dioxide, of being soluble in the wetting liquid such as hydrogen sulfide for example.

What is claimed is:

1. A process for displacing hydrocarbons retained in the pores of reservoir rocks of an underground reservoir, comprising forcibly injecting fluid slugs, through one or more injection wells successively, the fluid slugs comprising at least wetting liquid slugs saturated with a pressurized gas that is soluble in said wetting liquid and gas slugs intended to sweep the more permeable zones; relieving the pressure prevailing in the reservoir so as to generate in situ gas bubbles by nucleation in the pores of less permeable zones and to drive the hydrocarbons therefrom towards more permeable zones where they are swept by the gas slugs; and recovering the hydrocarbons through one or more production wells.

2. A process as claimed in claim 1, characterized in that the wetting fluid is water, at least one injected water slug being saturated with pressurized carbon dioxide.

3. A process as claimed in claim 1, characterized in that the wetting fluid is water, at least one injected water slug being saturated with hydrogen sulfide.

4. A process as claimed in claim 1, characterized in that at least one of the wetting liquid slugs injected comprises water to which a substance suited to make the spreading coefficient of drops of the hydrocarbon negative, has been added.

5. A process as claimed in claim 4, characterized in that at least one of the fluid slugs injected comprises water without additive.

6. A process as claimed in claim 1, characterized in that at least one of the fluid slugs injected comprises water to which foaming agents or surfactants have been added so that the pressure decrease in the reservoir generates in-situ formation of foams or emulsions.

7. A process as claimed in claim 4, wherein the substance is an alcohol.

* * * * *